US007451720B2

(12) United States Patent
Somers

(10) Patent No.: US 7,451,720 B2
(45) Date of Patent: Nov. 18, 2008

(54) FLAGPOLE ASSEMBLIES

(75) Inventor: James Scott Somers, Dallas, TX (US)

(73) Assignee: Concord Industries, Inc., Addison, TX (US)

( * ) Notice: Subject to any disclaimer, the term of this patent is extended or adjusted under 35 U.S.C. 154(b) by 134 days.

(21) Appl. No.: 11/083,483

(22) Filed: Mar. 18, 2005

(65) Prior Publication Data

US 2006/0005505 A1 Jan. 12, 2006

Related U.S. Application Data

(63) Continuation-in-part of application No. 10/885,358, filed on Jul. 6, 2004, now abandoned.

(51) Int. Cl.
*G09F 17/00* (2006.01)
*E04H 12/32* (2006.01)

(52) U.S. Cl. ..... 116/173; 116/174; 52/40; 52/651.02; 52/843; 52/834

(58) Field of Classification Search ..... 52/40, 52/736.1, 736.3, 726.4, 737.4, 651.02, 651.01, 52/848, 834, 836, 843, 835; 116/173, 174, 116/66, 67, 175; 254/266; 343/874; 174/45 R; 242/317, 370
See application file for complete search history.

(56) References Cited

U.S. PATENT DOCUMENTS 1,645,645 A * 10/1927 Davis ..... 116/173
1,763,156 A * 6/1930 Johnston ..... 52/736.4
2,440,500 A * 4/1948 Ellis ..... 116/173
2,530,654 A * 11/1950 Ellis ..... 116/173
2,985,261 A * 5/1961 Kubesh ..... 52/120
3,196,990 A * 7/1965 Handley ..... 52/732.3
3,300,185 A * 1/1967 Metzger et al. ..... 254/134.3 R
3,364,952 A * 1/1968 Scaglione et al. ..... 138/92
3,418,967 A * 12/1968 Donkersloot ..... 116/173
3,550,637 A * 12/1970 Briden ..... 138/92
3,675,615 A * 7/1972 Stangarone et al. ..... 116/173
3,976,283 A * 8/1976 Schmit ..... 254/387
4,332,210 A * 6/1982 Lambert ..... 116/173
4,889,321 A * 12/1989 Burns ..... 254/332
4,914,258 A * 4/1990 Jackson ..... 174/45 R
5,403,219 A * 4/1995 Ryan ..... 441/11

(Continued)

FOREIGN PATENT DOCUMENTS

FR 2596185 * 9/1987 ..... 116/173

(Continued)

OTHER PUBLICATIONS

Concord Industries, Inc., Flagpoles brochure, copyright 2000.

*Primary Examiner*—Phi D. A
(74) *Attorney, Agent, or Firm*—Gardere Wynne Sewell, LLP

(57) ABSTRACT

A flagpole assembly comprising a flagpole body having an aperture disposed in the side thereof, one or two internal fastening plates, disposed within the flagpole body, an external fastening plate and door assembly and a set of threaded fasteners securing the flagpole assembly together. A cleat or winch mount may be secured to the internal fastening plate, having a winch secured thereto for securement of a flag halyard inside the flagpole body.

13 Claims, 7 Drawing Sheets

U.S. PATENT DOCUMENTS 5,524,411 A * 6/1996 Crossman ..... 52/736.1
5,581,958 A * 12/1996 Cote ..... 52/40
5,820,255 A * 10/1998 Carrington et al. ..... 362/431
5,847,318 A * 12/1998 Chapman ..... 174/45 R
5,953,842 A * 9/1999 Bodell ..... 40/570
5,983,825 A * 11/1999 Nowak et al. ..... 116/173
6,064,005 A * 5/2000 Raasch ..... 174/66
6,089,396 A * 7/2000 Pozek ..... 220/251
6,118,074 A * 9/2000 Turcovsky et al. ..... 174/66
6,204,446 B1 * 3/2001 Parduhn ..... 174/45 R
6,380,909 B1 * 4/2002 Wilkinson et al. ..... 343/890
6,833,505 B1 * 12/2004 Macchietto ..... 174/66
6,952,695 B1 * 10/2005 Trinks et al. ..... 707/7

FOREIGN PATENT DOCUMENTS

FR 2647579 * 11/1990 ..... 116/173
JP 1-167885 * 7/1989 ..... 116/173
JP 1-224793 * 9/1989 ..... 116/173

* cited by examiner 400
402
416
426
436
440
442
444
436

500
502
516
536
540
526
536

324
320
324
324
320
324
316
322
324
324
324

324
318
320
324
316
324

FLAGPOLE ASSEMBLIES

CROSS REFERENCE TO RELATED APPLICATION

This application is a continuation-in-part of application Ser. No. 10/885,358, filed Jul. 6, 2004.

FIELD OF THE INVENTION

The present invention generally relates to flagpole winches, cleats and fastening plates, and more particularly to flagpole fastening plate assemblies and flagpole winch or cleat assemblies mounted internally to a flagpole.

BACKGROUND OF THE INVENTION

It is often desirable to substantially eliminate exposed flag halyards, especially while a flag is flying from a flagpole. There are flagpole assemblies in which the halyard remains substantially concealed from view but allows the flag to be raised and lowered. The flagpole assembly includes a hollow pole mounted at its base to a support. A first end of a halyard is connected to a winch. The winch is typically mounted near the base of the pole. The halyard passes through the hollow pole and out an exit opening at the pole tip.

Paying out the halyard from the winch causes the flag to lower as the length of the halyard extending from the exit opening in the hollow pole increases. The halyard is retracted by winding the halyard onto the winch. If the halyard has a flag attached to it, the flag is raised by this operation. If not, substantially the entire halyard is housed within the hollow pole or on the halyard winch.

A primary advantage of this design is that it simplifies raising and lowering of a flag while keeping the halyard substantially concealed. Keeping the halyard substantially concealed reduces deterioration of the halyard by preventing its exposure to the elements. It also eliminates problems caused by tangled halyards and flags.

SUMMARY OF THE INVENTION

The present invention provides a flagpole assembly including a hollow flagpole body, one or more internal fastening plates, an external fastening plate, and plural fasteners for securing the plates to the flagpole body. The embodiments of the invention may also include halyard handling mechanism disposed in the flagpole body.

The flagpole body is generally-cylindrical having a first end, a second end, a principal axis, an inner surface, an outer surface and an aperture disposed in the side thereof. The aperture extends from the inner surface to the outer surface along a radial axis substantially orthogonal to the principal axis. At least one internal fastener receiving hole or opening extends from the inner surface to the outer surface.

One or at least two internal fastening plates may be disposed at least partly within the flagpole body, and include inner surfaces, outer surfaces, an aperture disposed therein, or formed thereby, and threaded fastening holes generally aligned to fastener openings or passages in the flagpole body, respectively. The external fastening plate may be disposed at least partly outside of the flagpole body, and has an inner surface, an outer surface, an aperture disposed therein and external fastener passages generally aligned to corresponding fastener passages in the flagpole body. Threaded fasteners are disposed partly within external fastener passages, partly within internal fastener passages and partly within threaded fastener receiving holes.

In a second or alternate embodiment, the present invention provides a flagpole assembly including a flagpole body, an internal fastening plate or plates, an external fastening plate, plural threaded fasteners and a halyard engaging cleat or a winch mount. In other respects the embodiment which includes the winch mount is substantially like the embodiment mentioned hereinabove.

In a third embodiment, the present invention provides a flagpole assembly including a flagpole body, one or more internal fastening plates, an external fastening plate and door assembly and a winch mount. In the third embodiment, the external fastening plate and door assembly is disposed at least partly outside of the flagpole body, and has an inner surface, an outer surface, a door aperture having a door disposed therein and at least four external fastener passages, each external fastener passage being generally aligned to an internal fastener passage in the flagpole body. The winch mount includes an internal fastening plate and a winch secured thereto.

Those skilled in the art will further appreciate the above-mentioned advantages and features of the invention together with other important aspects thereof upon reading the detailed description which follows in conjunction with the drawings.

DETAILED DESCRIPTION OF THE PREFERRED EMBODIMENTS

Figure 1:
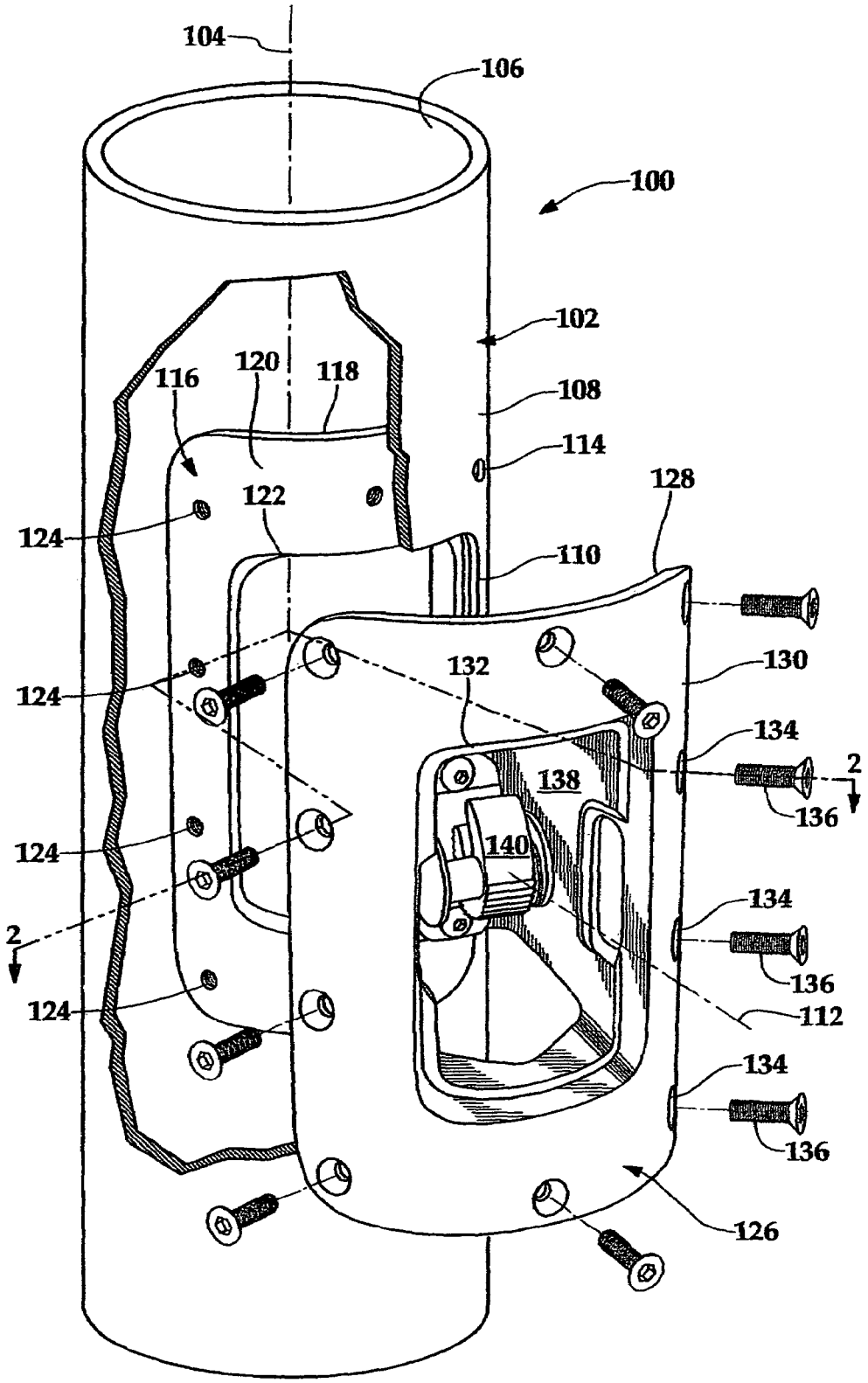
FIG. 1 is an exploded perspective view of a flagpole assembly according to one preferred embodiment of the present invention.

In the description which follows like elements are marked throughout the specification and drawing with the same reference numerals, respectively. The drawings are not necessarily to scale and certain features may be shown in somewhat schematic or generalized form in the interest of clarity and conciseness.

Flagpole assembly 100 includes a tubular flagpole body 102 having a principal central axis 104, an inner surface 106, an outer surface 108 and an aperture 110 disposed in its side along radial axis 112, which is generally-orthogonal to principal axis 104. A set of fastener receiving passages 114, one shown in FIG. 1, is disposed adjacent to aperture 110.

Figure 2:
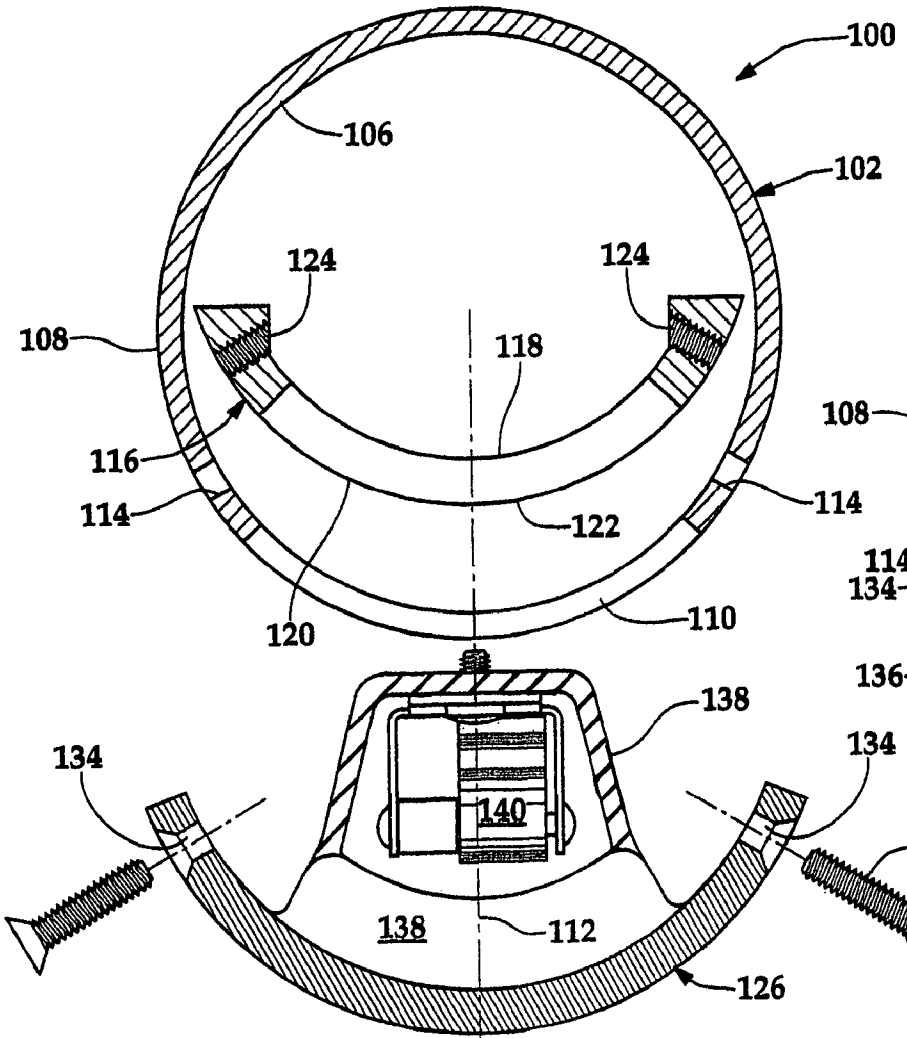
FIG. 2 is an exploded section view of the flagpole assembly of FIG. 1 taken along line 2-2 of FIG. 1.
Figure 4:
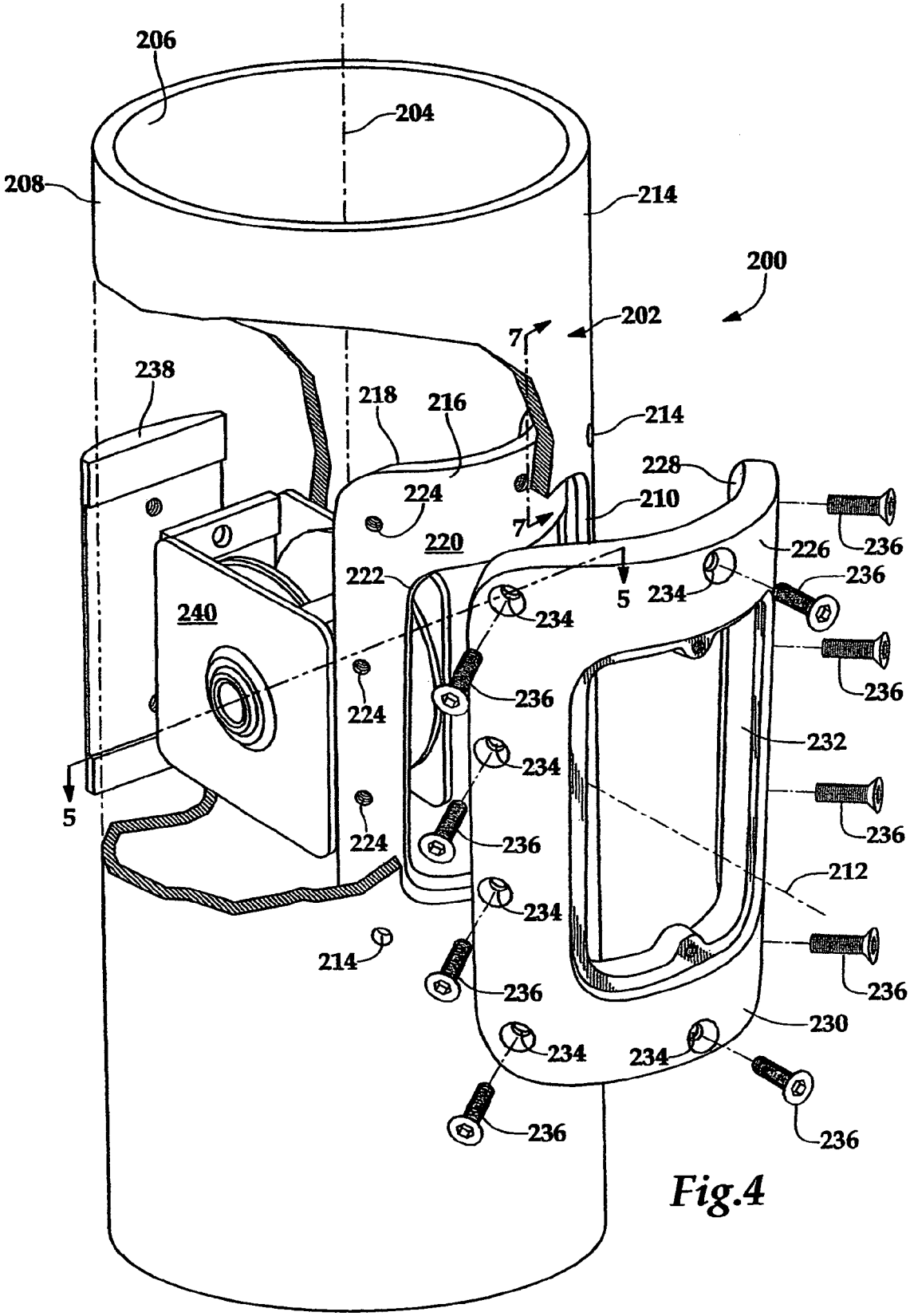
FIG. 4 is an exploded perspective view of a flagpole assembly according to another preferred embodiment of the present invention.

Flagpole assembly 100 also includes an internal fastening plate 116 having an inner surface 118, an outer surface 120 and an aperture 122. Plate 116 has a somewhat circular segment shape in cross section as shown in FIG. 2. A set of threaded fastener receiving holes 124 is disposed about aperture 122. Each of the threaded holes 124 is positioned to be aligned with a corresponding internal fastener passage 114.

Flagpole assembly 100 also includes an external fastening plate 126 having an inner surface 128, FIG. 1, an outer surface 130, an aperture 132 and a somewhat circular segment shape in cross section, also as shown in FIG. 2. A set of fastener receiving passages 134 is disposed in the external fastening plate 126 adjacent to the aperture 132. Each of the external fastener passages 134 is positioned to be aligned with a corresponding internal fastener passage 114 and a threaded fastener receiving passage or hole 124. A mount 138, including a halyard cleat 140, is secured to or formed integral with external fastening plate 126. In alternate embodiments, a pulley, a winch or other mechanism, not shown, may be supported on mount 138. A set of threaded fasteners 136 is operable to fasten the components described above of flagpole assembly 100 together.

Figure 3:
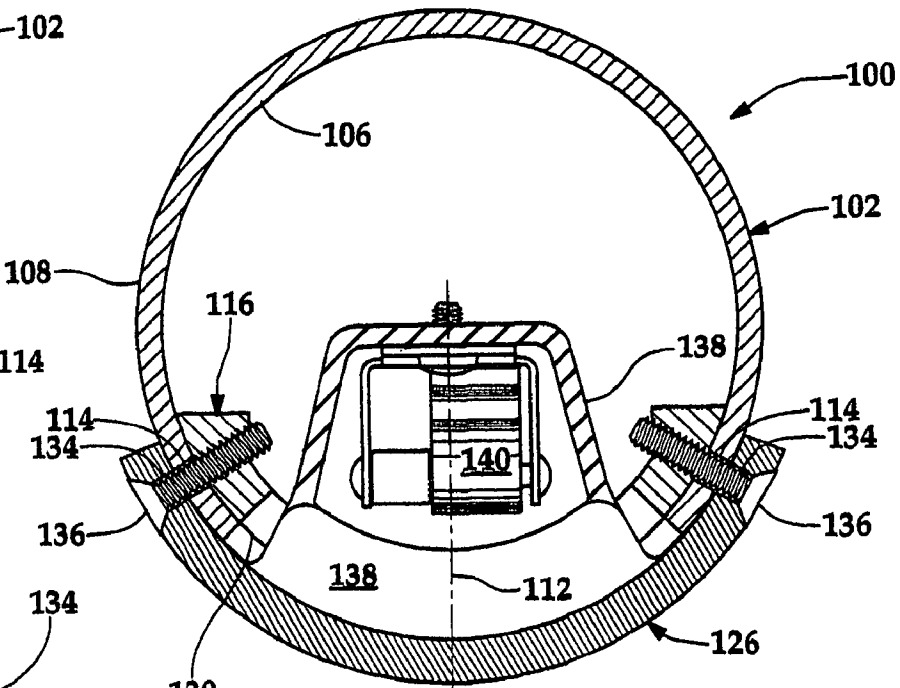
FIG. 3 is an unexploded section view of the flagpole assembly of FIG. 1 taken along line 2-2.

Another preferred embodiment of the present invention is shown in FIGS. 4-7 and comprises a flagpole assembly 200. Flagpole assembly 200 includes a flagpole body 202 having a principal central axis 204, an inner surface 206, an outer surface 208 and an aperture 210 disposed in its side along a radial axis 212, which is generally-orthogonal to principal axis 204. Fastener receiving passages 214 are disposed adjacent to aperture 210, as shown and similar to the arrangement for the embodiment of FIGS. 1 through 3.

Flagpole assembly 200 also includes a generally rectangular internal fastening plate 216 having an inner surface 218, an outer surface 220 and an aperture 222. A set of threaded fastener receiving holes 224 is disposed about aperture 122. Each of the threaded fastening holes 224 is aligned with a corresponding fastener receiving passage 214. Flagpole assembly 200 includes an external fastening plate 226 having an inner surface 228, an outer surface 230 and a door aperture 232. A set of external fastener receiving passages 234 is disposed in the external fastening plate 226 adjacent to the door aperture 232. Each of the external fastener passages 234 is aligned to a corresponding fastener receiving passage 214 and a threaded fastener receiving hole 224. A mount plate or block 238 includes an arcuate surface 239 and a threaded fastener receiving hole 238*a* formed therein, FIGS. 5 and 6. Plate or block 238 is operable for securing a winch 240, FIG. 6, to the flagpole body 202. Plate 238 is adapted to be secured to body surface 206 by a fastener assembly 207, 209, FIG. 5. A set of threaded fasteners 236 fastens the plates 218 and 226 of the flagpole assembly 200 together.

The internal and external plates used in flagpole assemblies may vary from one application to another. FIGS. 8 through 17 depict variations on the shapes and configurations of the internal and external plates, which may be operable in the flagpole assemblies of the present invention.

Referring to FIGS. 8 through 11, external plate 326 has a transverse shape of a segment of a cylinder. External plate 326 has an arcuate external surface 330, an arcuate internal surface 338 and an aperture 332 disposed in the center thereof. A set of fastener receiving passages or bores 334 is spaced about the aperture 332 in a generally rectangular pattern. In the embodiment shown in FIGS. 8-11, the fastener receiving bores 334 are preferably countersunk.

Figures 12, 13, 14, 15:
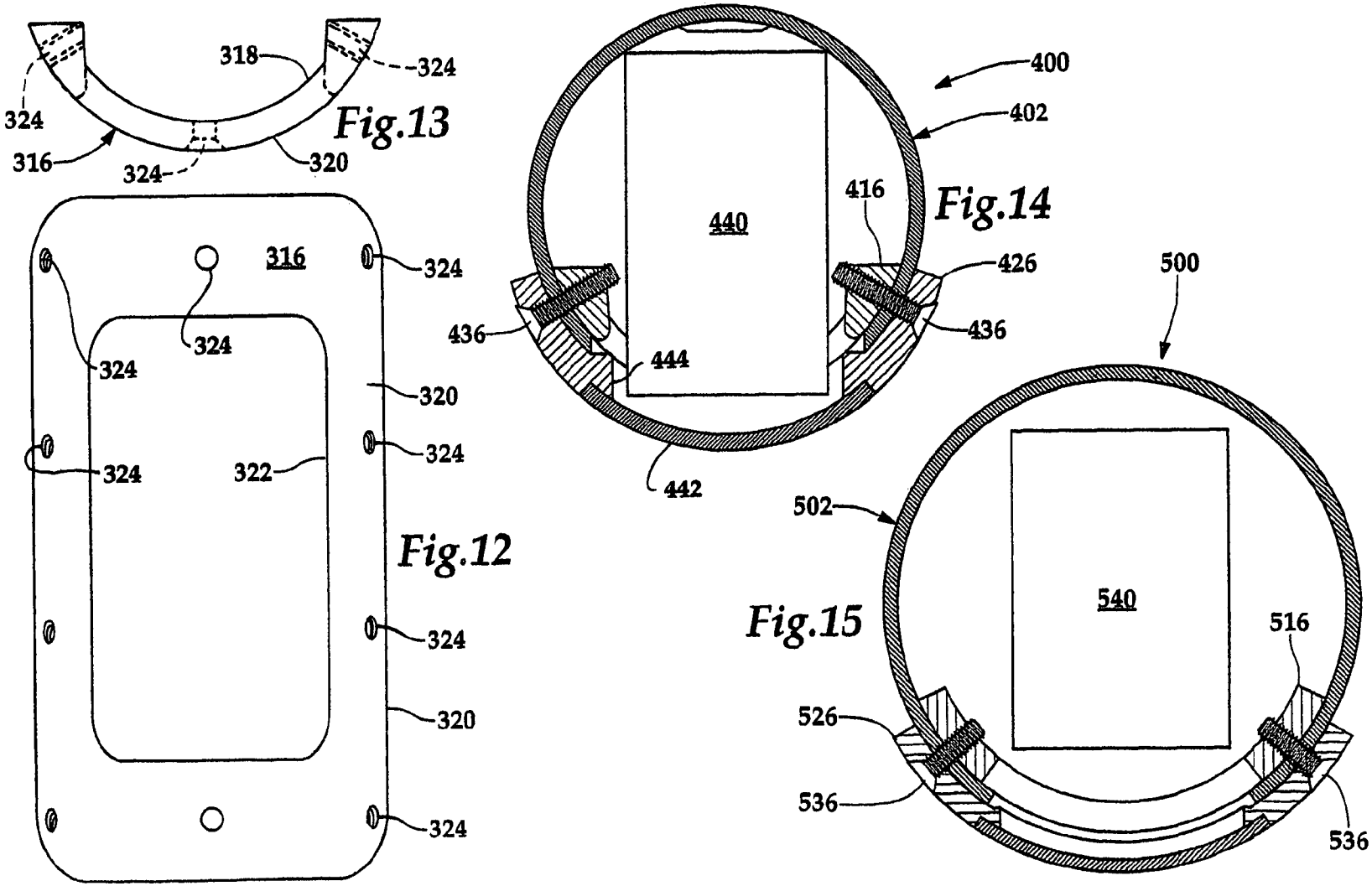
FIG. 12 is a front elevation view of an internal plate which may be used in the flagpole assembly of FIGS. 1 and 4.
FIG. 13 is a top plan view of the internal plate of FIG. 12.
FIG. 14 is a transverse section view of another embodiment of the flagpole assembly.
FIG. 15 is a transverse section view of still another embodiment of the flagpole assembly.

Referring to FIGS. 12 and 13, internal plate 316 also has the general profile or transverse cross section shape of a segment of a cylinder. Internal plate 316 has an internal surface 318, an external surface 320 and an aperture 322 disposed in the center thereof. A set of fastener receiving holes 324 is spaced about the aperture 322 in a generally rectangular pattern. In the embodiment shown in FIGS. 8-11, the fastener or receiving holes 324 are preferably threaded, as shown.

Figures 5, 6, 7:
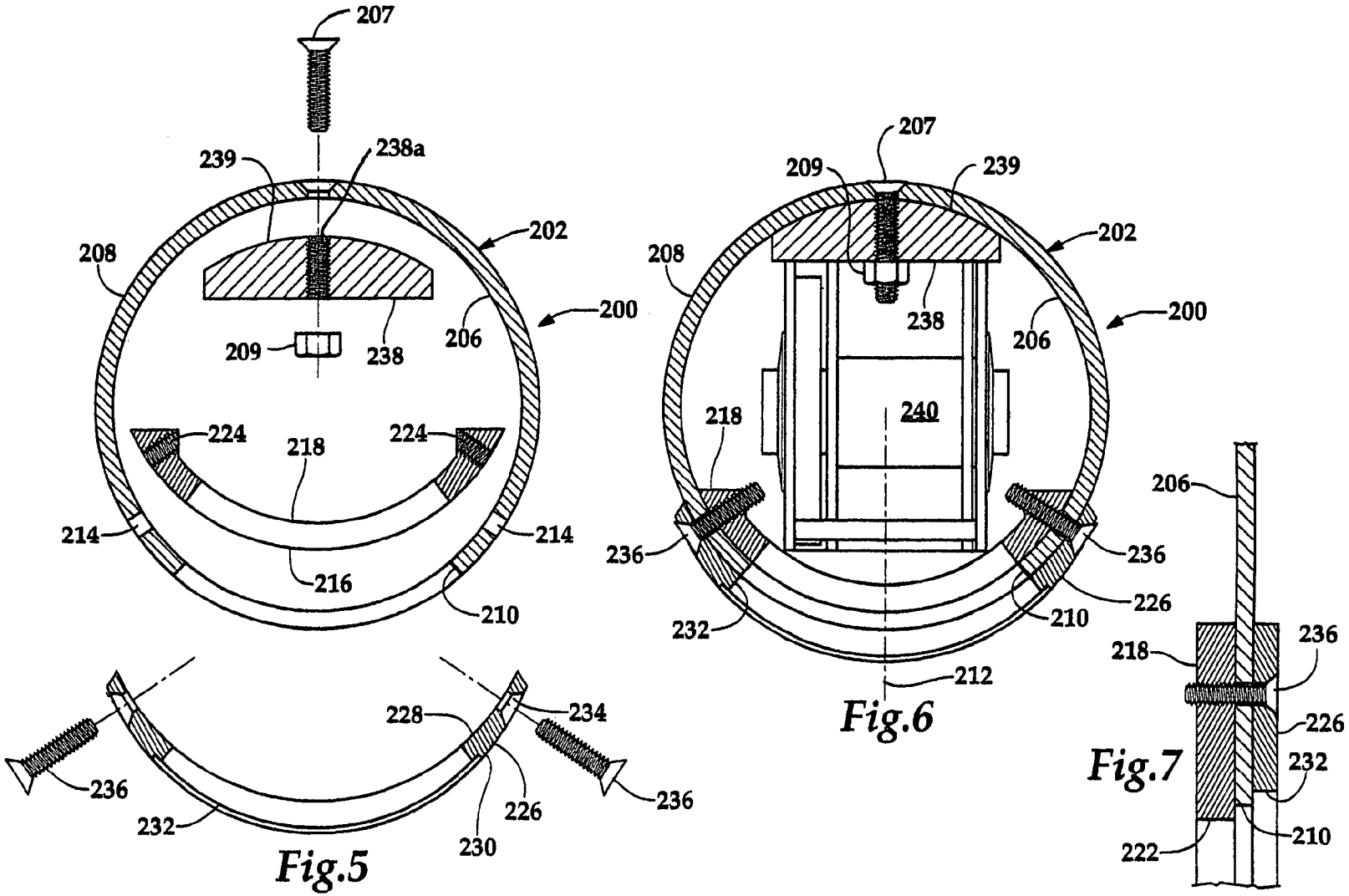
FIG. 5 is an exploded section view of the flagpole assembly of FIG. 4 taken along line 5-5 of FIG. 4.
FIG. 6 is an unexploded section view of the flagpole assembly of FIG. 4 taken along line 5-5.
FIG. 7 is a detail section view of the flagpole assembly of FIG. 4 taken along line 7-7 of FIG. 4.
Figure 9:
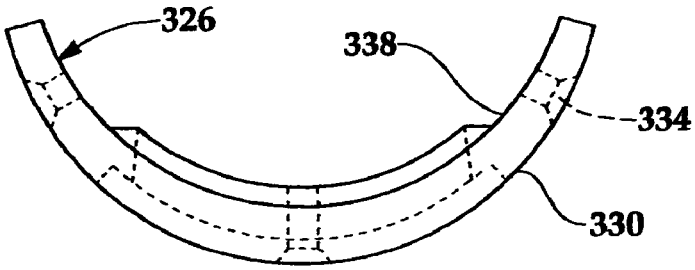
FIG. 9 is a top plan view of the external plate of FIG. 8.
Figure 8:
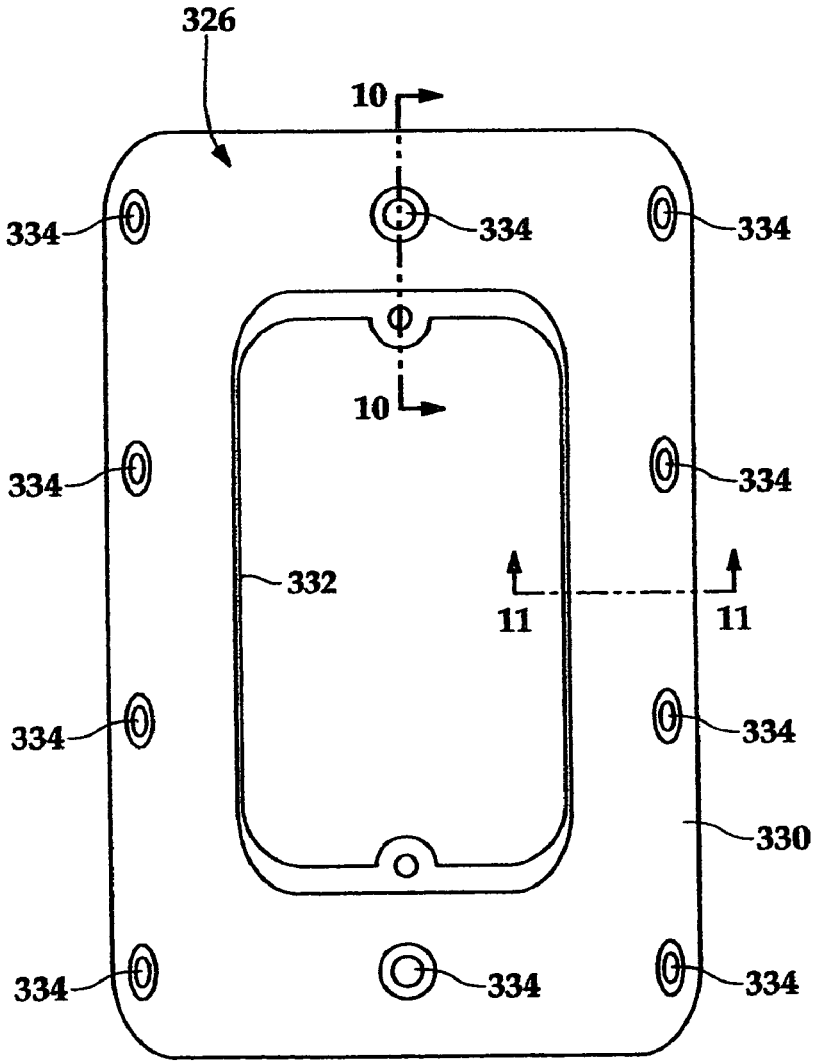
FIG. 8 is a front elevation view of an external plate which may be used in the flagpole assembly of FIG. 4.
Figure 10:
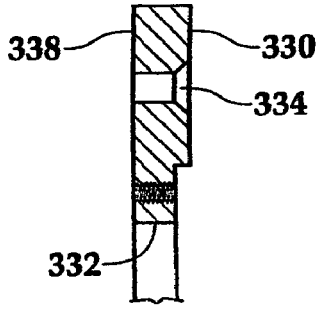
FIG. 10 is a detail section view of the external plate of FIG. 9 taken along line 10-10 of FIG. 9.
Figure 11:
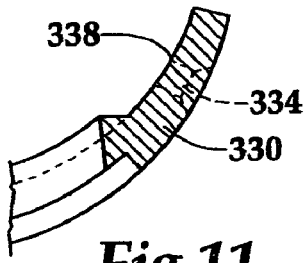
FIG. 11 is a detail section view of the external plate of FIG. 8 taken along line 11-11 of FIG. 8.

Alternate flagpole assemblies 400 and 500 are shown as examples of variations on the geometry of flagpole assembly 200. Flagpole assembly 400 is shown in FIG. 14 and includes a flagpole body 402 having an internal plate 416 and a winch assembly 440 disposed therein, and an external plate 426 disposed on the outside thereof. Internal plate 416 and external plate 426 are fastened to the flagpole body 402 and to one another by fasteners 436. Flagpole assembly 400 incorporates an operable or removable door or cover 442 covering an aperture 444 to enclose and protect winch assembly 440 or other device from the elements and unwanted tampering. Similarly, flagpole assembly 500 includes a flagpole body 502 having an internal plate 516 and winch assembly 540 disposed therein and an external plate 526 disposed on the outside thereof. Internal plate 516 and external plate 526 are fastened to the flagpole body 502 and to one another by fasteners 536. Flagpole assembly 500 also incorporates a removable door 542 to enclose and protect the winch assembly from the elements and tampering. It can be seen that flagpole assemblies 400 and 500 employ the same basic layout as flagpole assembly 200, although the geometry of the components varies between the three, as seen in FIGS. 6, 14 and 15.

Figure 16:
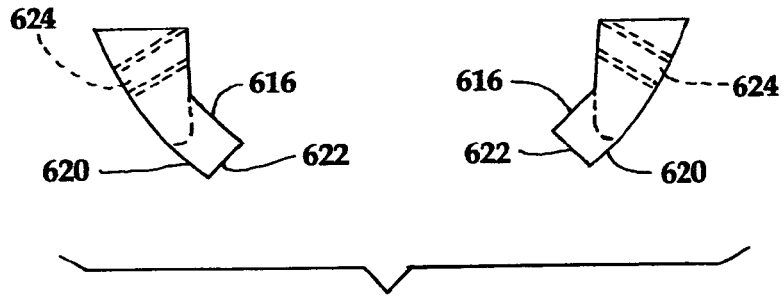
FIG. 16 is a top plan view of another embodiment of plural internal plates which may be used with the flagpole assemblies of the present invention.
Figure 17:
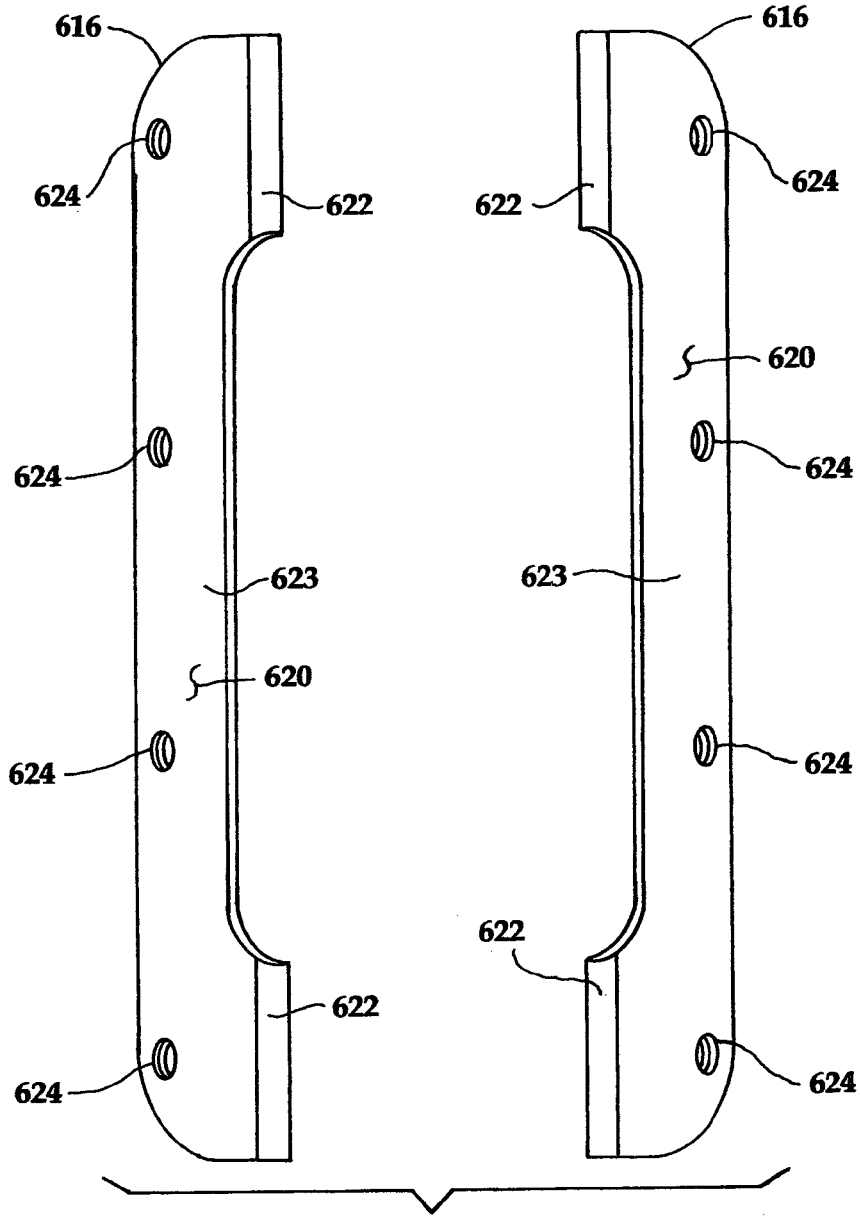
FIG. 17 is a front elevation of the plural internal plates shown in FIG. 16.

Referring now to FIGS. 16 and 17, the internal plates previously described are single piece structures. However, in certain instances certain dimensions, such as the wall thickness of the flagpole body, may vary whereby the fastener receiving holes in the internal plates will not necessarily be aligned with the fastener receiving holes in the flagpole body or the external plates. Accordingly, the present invention contemplates the provision of separate but substantially identical internal plates designated by the numerals 616 in FIGS. 16 and 17. The internal plates 616 include arcuate external surfaces 620 and may have a somewhat shallow U-shape with opposed relatively short legs 622 formed thereon, respectively, and interconnected by web portions 623, respectively. Accordingly, the internal plates 616 have essentially the shape of the internal plates described above, in some respects. Internal plates 616 are also provided with spaced apart threaded fastener receiving holes 624, as shown, for receiving fasteners, such as the fasteners 136, 236, 336 or 436, not shown in FIGS. 16 and 17.

The components of the flagpole assemblies described herein may be fabricated as cast metal, such as aluminum or similar metals or other materials suitable for exposure to the elements and incorporating the strength requirements of such structures.

Those of skill in the art will appreciate that flagpole assemblies 200, 300, 400, 500 are only exemplary and that other geometries may be employed.

In general, although preferred embodiments have been described herein, those skilled in the art will appreciate that substitutions and modifications may be made without departing from the scope and spirit of the appended claims.

What is claimed is:

1. A flagpole assembly comprising:

a generally-cylindrical, hollow flagpole body having a principal central axis, an inner surface, an outer surface, an aperture disposed in the side thereof, passing from the inner surface to the outer surface along a radial axis substantially orthogonal to the principal axis and plural internal fastener receiving passages passing from the inner surface to the outer surface;

an internal fastening plate, disposed at least partly within the flagpole body, having an inner surface, an outer surface, an aperture disposed therein and at least two threaded fastener receiving holes, each generally aligned to a corresponding fastener receiving passage in the flagpole body;

an external fastening plate, disposed at least partly outside of the flagpole body, having an inner surface, an outer surface, an aperture disposed therein and at least two external fastener receiving passages, each generally aligned to an internal fastener receiving passage in the flagpole body;

plural threaded fasteners, each disposed within an external fastener receiving passage, an internal fastener receiving passage and a threaded fastener receiving hole respectively; and a substantially rectangular winch mount having a longitudinal axis substantially parallel to the principal central axis of said flagpole body, an inner surface and an outer surface, the outer surface having a profile conforming to the flagpole body, and the inner surface being substantially planar and opposite said outer surface, the winch mount having a winch secured to the inner surface and fully contained within the flagpole body, wherein the aperture is positioned at one end of the diameter of the flagpole body that is collinear with the radial axis and the winch mount is positioned at the other end of the flagpole body diameter thus opposite the aperture.

2. The flagpole assembly of claim 1 wherein the internal fastening plate has an outer surface having a profile conforming to the profile of a cylinder.

3. The flagpole assembly of claim 1 wherein the external fastening plate has an inner surface having a profile conforming to the profile of a cylinder.

4. The flagpole assembly of claim 1 wherein at least one fastener receiving passage is disposed at a first end of the aperture and at least one fastener receiving passage is disposed at a second end of the aperture.

5. The flagpole assembly of claim 1 wherein at least four fastener receiving passages are provided in the flagpole body disposed in a rectangular pattern about the aperture.

6. The flagpole assembly of claim 5 wherein the fastener passages are disposed in at least four linear patterns about the aperture, with each pattern comprising two or more fastener passages.

7. The flagpole assembly of claim 1 wherein the external fastener receiving passages in the external fastening plate are countersunk.

8. A flagpole assembly comprising:

a generally-cylindrical, hollow flagpole body having a first end, a second end, a principal central axis, an inner surface, an outer surface, an aperture disposed in the side thereof, passing from the inner surface to the outer surface along a radial axis substantially orthogonal to the principal axis and plural internal fastener receiving passages passing from the inner surface to the outer surface;

opposed internal fastening plates, disposed within the flagpole body, each having an inner surface, an outer surface, and threaded fastener receiving holes, each threaded fastener receiving hole being generally aligned to an internal fastener receiving passage in the flagpole body;

an external fastening plate disposed outside of the flagpole body, having an inner surface, an outer surface, an aperture having a door disposed therein and external fastener receiving passages, each fastener receiving passage being generally aligned to a corresponding fastener receiving passage in the flagpole body; and plural threaded fasteners, each disposed within an external fastener receiving passage, an internal fastener receiving passage and a threaded fastener receiving hole; and a substantially rectangular winch mount having a longitudinal axis substantially parallel to said principal central axis of said flagpole body, an inner surface and an outer surface, the outer surface having a profile conforming to the flagpole body, and the inner surface being substantially planar and opposite said outer surface, the winch mount having a winch secured to the inner surface and fully contained within the flagpole body, wherein the aperture is positioned at one end of the diameter of the flagpole body that is collinear with the radial axis and the winch mount is positioned at the other end of the flagpole body diameter thus opposite the aperture.

9. The flagpole assembly of claim 8 wherein the internal fastening plates each have an outer surface having a profile conforming to the profile of a cylinder.

10. The flagpole assembly of claim 8 wherein the external fastening plate has an inner surface having a profile conforming to the profile of a cylinder.

11. The flagpole assembly of claim 8 including a door closeable over said aperture.

12. The flagpole assembly of claim 11 wherein fastener receiving passages are disposed in linear patterns about the aperture, with each pattern comprising at least two fastener receiving passages.

13. The flagpole assembly of claim 11 wherein fastener receiving passages are disposed in linear patterns about the aperture, with each pattern comprising at least two fastener passages.

* * * * *